US007376366B2

(12) United States Patent
Deguchi

(10) Patent No.: US 7,376,366 B2
(45) Date of Patent: May 20, 2008

(54) IMAGE-FORMING DEVICE WITH POWER SUPPLYING UNIT

(75) Inventor: Hideaki Deguchi, Nagoya (JP)

(73) Assignee: Brother Kagyo Kabushiki Kaisha, Nagoya-shi, Aichi-ken (JP)

( * ) Notice: Subject to any disclaimer, the term of this patent is extended or adjusted under 35 U.S.C. 154(b) by 351 days.

(21) Appl. No.: 11/199,260

(22) Filed: Aug. 9, 2005

(65) Prior Publication Data

US 2006/0029410 A1 Feb. 9, 2006

(30) Foreign Application Priority Data

Aug. 9, 2004 (JP) ..... 2004-232590

(51) Int. Cl.
*G03G 15/16* (2006.01)

(52) U.S. Cl. ..... 399/66; 399/88

(58) Field of Classification Search ..... 399/66, 399/88, 89

See application file for complete search history.

(56) References Cited

U.S. PATENT DOCUMENTS 5,684,685 A * 11/1997 Komatsu et al. ..... 399/88
5,893,661 A * 4/1999 Sakai et al. ..... 399/66
5,903,798 A * 5/1999 Yokogawa et al. ..... 399/66
5,646,717 A1 7/2001 Hiroshima et al.
6,266,495 B1 7/2001 Yuminamochi et al.
6,963,701 B2 * 11/2005 Inukai ..... 399/66
7,266,318 B2 * 9/2007 Inukai ..... 399/66

FOREIGN PATENT DOCUMENTS

| | | |
|---|---|---|
| JP | 04-025885 | 1/1992 |
| JP | 05-011645 | 1/1993 |
| JP | 06-308844 | 11/1994 |
| JP | 10-301408 | 11/1998 |
| JP | 11-258931 | 9/1999 |
| JP | 2000-075693 | 3/2000 |
| JP | 2002-162844 | 6/2002 |

* cited by examiner

*Primary Examiner*—William J. Royer
(74) *Attorney, Agent, or Firm*—Banner & Witcoff, Ltd

(57) ABSTRACT

An image-forming device has an image-carrying unit, a transferring unit, a power-supplying unit, a current-detecting unit, a voltage-detecting unit, a memory unit, and a controller. The power-supplying unit supplies voltage and current to the transferring unit to transfer a toner onto a recording medium. The current-detecting unit detects the current flowing in the transferring unit. The voltage-detecting unit detects the voltage applied to the transferring unit. The memory unit stores a characteristic curve indicating a correlation between an optimal current and at least the detected voltage. The optimal current enables the transferring unit to transfer the toner supported on the image-carrying unit onto the recording medium. The controller controls the power-supplying unit to supply the optimal current to the transferring unit.

32 Claims, 6 Drawing Sheets

IMAGE-FORMING DEVICE WITH POWER SUPPLYING UNIT

BACKGROUND OF THE INVENTION

1. Field of the Invention

The present invention relates to an image-forming device, and particularly to a control of the power supplied to transferring means provided in the image-forming device.

2. Description of Related Art

In an image-forming device, electrical resistance in the transferring means, image-carrying member, and recording paper interposed between the transferring means and image-carrying member can fluctuate greatly due to ambient conditions (particularly temperature and humidity). Hence, the image-forming device must adjust the power supply to adapt to changes in the ambient conditions. An insufficient power supply may cause toner to scatter on the recording paper due to an insufficient force for depositing the toner. Further, toner that is not transferred onto the recording paper but remains on the image-carrying member may be mistakenly transferred onto the recording paper at another position. Conversely, if the power supply is excessive, electrical discharge may result in damage to the image-carrying member.

A method of controlling power supply has been disclosed in Japanese unexamined patent application publication No. HEI-6-308844. In this method, a characteristic curve for the optimal voltage and measured current is prepared for each output voltage applied to the transferring means. The characteristic curve corresponding to the current output voltage is selected, and control is performed based on this characteristic curve in order to achieve an optimal output voltage corresponding to the currently measured current value.

However, Japanese unexamined patent application publication No. HEI-6-308844 does not explicitly describe how the characteristic curve is derived, and it has been difficult to determine whether optimal power control can be achieved.

SUMMARY OF THE INVENTION

In view of the foregoing, it is an object of the present invention to provide an image-forming device capable of performing precise power control with high response by suppressing the effects of changes in load resistance on the transferring means.

In order to attain the above and other objects, the present invention provides an image-forming device having an image-carrying unit, a transferring unit, a power-supplying unit, a current-detecting unit, a voltage-detecting unit, a memory unit, and a controller. The image-carrying unit supports a toner. The transferring unit transfers the toner supported on the image-carrying unit onto a recording medium. The transferring unit opposes to the image-carrying unit at a transferring position. The power-supplying unit supplies voltage and current to the transferring unit to transfer the toner onto the recording medium. The current-detecting unit detects the current flowing in the transferring unit. The voltage-detecting unit detects the voltage applied to the transferring unit. The memory unit stores a characteristic curve indicating a correlation between an optimal current and at least the detected voltage. The optimal current enables the transferring unit to transfer the toner supported on the image-carrying unit onto the recording medium The controller controls the power-supplying unit to supply the optimal current to the transferring unit.

Another aspect of the present invention provides an image-forming device having an image-carrying unit, a transferring unit, a power-supplying unit, a current-detecting unit, a voltage-detecting unit, a memory unit, and a controller. The image-carrying unit supports a toner. The transferring unit transfers the toner supported on the image-carrying unit onto a recording medium. The transferring unit opposes to the image-carrying unit at a transferring position. The power-supplying unit supplies voltage and current to the transferring unit to transfer the toner onto the recording medium. The current-detecting unit detects the current flowing in the transferring unit. The voltage-detecting unit detects the voltage applied to the transferring unit. The memory unit stores a characteristic curve indicating a correlation between an optimal voltage and at least the detected current. The optimal voltage enables the transferring unit to transfer the toner supported on the image-carrying unit onto the recording medium. The controller controls the power-supplying unit to supply the optimal voltage to the transferring unit.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

An image-forming device according to a first embodiment of the present invention will be described with reference to FIGS. 1 through 5C.

1. Overall Structure of the Image-Forming Device

Figure 1:
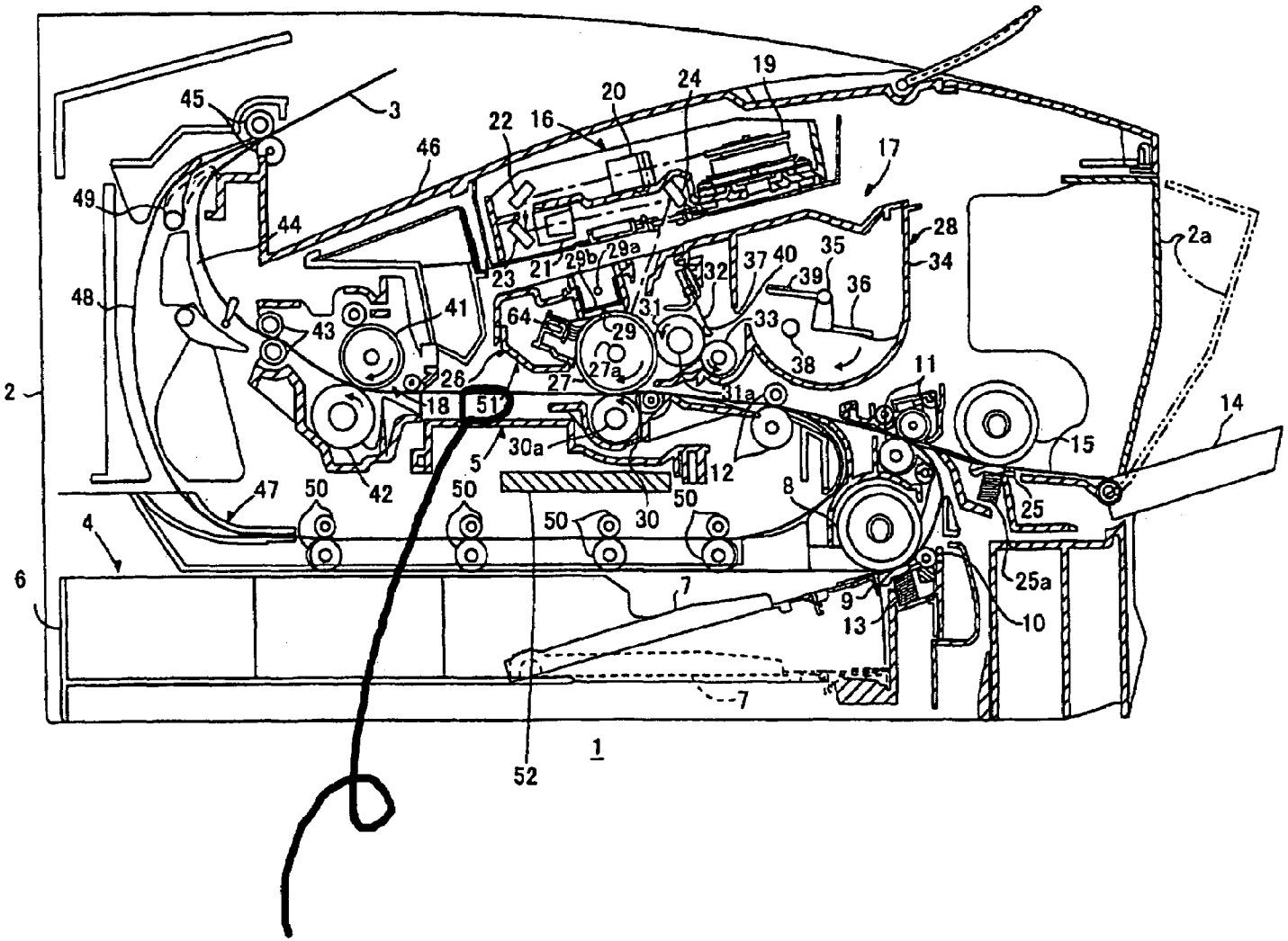
FIG. 1 is a side cross-sectional view of a laser printer according to a first embodiment of the present invention, showing the internal structure of the laser printer.

FIG. 1 is a side cross-sectional view showing a preferred embodiment of a laser printer 1, serving as the image-forming device of the present invention. The image-forming device to which the present invention is applied includes not only a laser printer and other printers, but also a facsimile device, and a multifunction device having a printing function, scanning function, and the like. As shown in FIG. 1, the laser printer 1 has a main frame 2 serving as the main body of the laser printer 1. Within the main frame 2 are provided a feeder unit 4, for supplying sheets of paper 3, an image-forming unit 5 for forming images on the paper 3 supplied from the feeder unit 4, and the like. The paper 3 includes transparency sheets and the like.

(1) Feeder Unit

The feeder unit 4 is disposed in a lower section of the main frame 2 and includes a paper tray 6, a paper pressing plate 7, a feeding roller 8, a separating pad 9, paper dust rollers 10 and 11, and registration rollers 12. The paper tray 6 is detachably mounted in the main frame 2. The pressing plate 7 is disposed inside the paper tray 6. The feeding roller 8 and the separating pad 9 are disposed above one end of the paper tray 6. This end is on the right side of FIG. 1 and hereinafter will be referred to as the "front side," while the opposite end on the left side of FIG. 1 will be referred to as the "rear side." The paper dust rollers 10 and 11 are disposed downstream of the feeding roller 8 with respect to the direction that the paper 3 is conveyed (paper conveying direction). The registration rollers 12 are disposed downstream of the paper dust rollers 10 and 11 with respect to the paper conveying direction.

A plurality of sheets of paper 3 can be stacked on the pressing plate 7. The pressing plate 7 is pivotably supported on the end farthest from the feeding roller 8 (rear end), enabling the end nearest the feeding roller 8 (front end) to move vertically. A spring (not shown) is disposed on the underside of the pressing plate 7, urging the pressing plate 7 upward. As the number of sheets of paper 3 stacked on the pressing plate 7 increases, the front end of the pressing plate 7 opposes the urging force of the spring and pivots downward about a point on the end farthest from the feeding roller 8 (rear end). The feeding roller 8 and separating pad 9 are disposed in confrontation with each other. A spring 13 disposed on the underside of the separating pad 9 presses the separating pad 9 toward the feeding roller 8.

The spring on the underside of the pressing plate 7 presses the paper 3 stacked on the pressing plate 7 toward the feeding roller 8 so that the topmost sheet of the paper 3 contacts the feeding roller 8. As the feeding roller 8 rotates, the topmost sheet of the paper 3 is conveyed between the feeding roller 8 and the separating pad 9. Through the cooperative operations of the feeding roller 8 and the separating pad 9, the paper 3 stacked on the pressing plate 7 is separated and supplied one sheet at a time.

The paper dust rollers 10 and 11 remove paper dust from the paper 3 supplied by the feeding roller 8 and convey the paper 3 to the registration rollers 12. The pair of registration rollers 12 registers the paper 3 and subsequently conveys the paper 3 to an image-forming position. The image-forming position denotes a position at which a toner image is transferred from a photosensitive drum 27 to the paper 3. In the preferred embodiment, the image-forming position is a position at which the photosensitive drum 27 contacts a transfer roller 30.

The feeder unit 4 of the laser printer 1 further includes a multipurpose tray 14, on which is stacked sheets of the paper 3, and a multipurpose feeding roller 15 and a multipurpose separating pad 25 for feeding the paper 3 stacked on the multipurpose tray 14. The multipurpose feeding roller 15 and the multipurpose separating pad 25 are disposed in confrontation with each other. A spring 25*a* disposed on the underside of the multipurpose separating pad 25 pushes the paper 3 stacked on the multipurpose tray 14 toward the multipurpose feeding roller 15.

As the multipurpose feeding roller 15 rotates, the topmost sheet of the paper 3 stacked on the multipurpose tray 14 is fed between the multipurpose feeding roller 15 and the multipurpose separating pad 25. Through the cooperative operations of the multipurpose feeding roller 15 and multipurpose separating pad 25, the paper 3 stacked on the multipurpose tray 14 is separated and fed one sheet at a time.

(2) Image-Forming Unit

The image-forming unit 5 includes a scanning unit 16, a process cartridge 17, and a fixing unit 18.

(a) Scanning Unit

The scanning unit 16 is disposed in an upper section of the main frame 2 and includes a laser light-emitting unit (not shown), a polygon mirror 19 that can be driven to rotate, lenses 20 and 21, and reflecting mirrors 22, 23, and 24. A laser beam is emitted by the laser light-emitting unit based on image data and, as indicated by a broken line in FIG. 1, sequentially passes through or reflects off of the polygon mirror 19, lens 20, reflecting mirrors 22 and 23, lens 21, and reflecting mirror 24 in the order given. The laser light is irradiated in a high-speed scanning operation on the surface of the photosensitive drum 27 located in the process cartridge 17.

(b) Process Cartridge

The process cartridge 17 is disposed below the scanning unit 16 and includes a drum cartridge 26, and a developing cartridge 28. The drum cartridge 26 is a photosensitive cartridge that can be mounted in or removed from the main frame 2. The developing cartridge 28 is accommodated in the drum cartridge 26. As shown in FIG. 1, a front cover 2*a* is provided on the front surface of the main frame 2. The front cover 2*a* is capable of swinging open or closed about a lower edge of the front cover 2*a*. The process cartridge 17 can be mounted inside the main frame 2 when the front cover 2*a* is open.

The developing cartridge 28 is detachably mounted on the drum cartridge 26 and includes a developing roller 31, a thickness regulating blade 32, a supply roller 33, and toner hopper 34.

The toner hopper 34 is filled with a nonmagnetic, single-component toner having a positive charge. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. By forming the polymerized toner as particles substantially spherical, the toner has excellent fluidity and can form images of high quality. The toner is compounded with a coloring agent such as carbon black or with a wax, as well as an additive such as silica to improve fluidity. The diameter of the toner particles is about 6-10 μm.

The developing cartridge 28 also includes a rotating shaft 35 disposed in the center of the toner hopper 34, an agitator 36 supported on the rotating shaft 35 and capable of rotating in a direction indicated by the arrow (clockwise in FIG. 1), and a toner supply opening 37 formed in a side of the toner hopper 34. The agitator 36 is driven to rotate by a motive force received from a motor (not shown). The rotating agitator 36 stirs toner in the toner hopper 34, causing some of the toner to be discharged through the toner supply opening 37. Windows 38 for detecting the amount of remaining toner are provided one in each side wall of the toner hopper 34 (the near and far sides in FIG. 1). Wipers 39 are supported on the rotating shaft 35 for cleaning the windows 38.

The supply roller 33 and developing roller 31 are disposed at a position rearward of the toner supply opening 37 and can rotate in contact with each other. The supply roller 33 and the developing roller 31 contact each other with a degree of pressure.

The supply roller 33 is configured of a metal roller shaft covered by a roller that is formed of an electrically conductive foam material. A motor (not shown) drives the supply roller 33 to rotate in the direction indicated by an arrow (counterclockwise in FIG. 1).

The developing roller 31 is configured of a metal roller shaft 31*a* covered by a roller that is formed of an electrically conductive rubber material. More specifically, the roller part of the developing roller 31 is formed of an electrically conductive urethane rubber or silicon rubber including fine carbon particles or the like, the surface of which rubber is coated with a urethane rubber or silicon rubber including fluorine. A motor (not shown) drives the developing roller 31 to rotate in a direction indicated by the arrow (counterclockwise in FIG. 1). During a developing operation, a prescribed developing bias is applied to the developing roller 31.

The thickness regulating blade 32 supported in the developing cartridge 28 is disposed near the developing roller 31. The thickness regulating blade 32 is configured of a metal leaf spring member, and a pressing part 40 provided on the free end of the leaf spring member. The pressing part 40 has a semicircular cross-section and is formed of an insulating silicon rubber. With this construction, the elastic force of the leaf spring member causes the pressing part 40 to contact the surface of the developing roller 31 with pressure.

Toner discharged through the toner supply opening 37 is supplied onto the developing roller 31 by the rotation of the supply roller 33. At this time, the toner is positively tribocharged between the supply roller 33 and the developing roller 31. As the developing roller 31 rotates, the toner supplied onto the surface of the developing roller 31 passes between the developing roller 31 and the pressing part 40 of the thickness regulating blade 32. The pressing part 40 smoothes the toner carried on the surface of the developing roller 31 to maintain a thin layer of toner with a uniform thickness.

The drum cartridge 26 includes the photosensitive drum 27, a Scorotron charger 29, the transfer roller 30, and a cleaning brush 64.

The photosensitive drum 27 is disposed to the rear of the developing roller 31 in confrontation with the same. The photosensitive drum 27 is supported on the drum cartridge 26 so as to be able to rotate in the direction of the arrow (clockwise in FIG. 1). The photosensitive drum 27 is formed of a main drum body that is cylindrical in shape, and a metal drum shaft 27*a*. The metal drum shaft 27*a* runs along the axial center of the main drum body for supporting the main drum body. The main drum body is configured of an aluminum tube. On the surface of the aluminum tube is formed a positive charging photosensitive layer of polycarbonate or the like. The metal drum shaft 27*a* is grounded (see FIG. 2).

The Scorotron charger 29 is supported in the drum cartridge 26 above the photosensitive drum 27, as shown in FIG. 1, and is separated a prescribed distance from the photosensitive drum 27 so as not to contact the same. The Scorotron charger 29 includes a charging wire 29*a* and a grid 29*b*. The charging wire 29*a* is formed of tungsten or the like. The grid 29*b* is disposed between the charging wire 29*a* and the photosensitive drum 27. The Scorotron charger 29 is a positive charging Scorotron charger that generates a corona discharge from the charging wire 29*a* when a prescribed charge bias voltage is applied to the charging wire 29*a*. The grid 29*b* acts on the corona discharge produced from the charging wire 29*a* to apply a charge of positive polarity to the surface of the photosensitive drum 27. Hence, the Scorotron charger 29 produces a uniform positive charge over the surface of the photosensitive drum 27 as the photosensitive drum 27 rotates.

After a uniform positive charge has been formed on the surface of the photosensitive drum 27, the charged surface is exposed to a laser beam emitted from the scanning unit 16 in a high-speed scan. The scanning unit 16 scans the laser beam to form an electrostatic latent image on the surface of the photosensitive drum 27 based on image data.

Next, the positively charged toner carried on the surface of the developing roller 31 is supplied to the electrostatic latent image formed on the surface of the photosensitive drum 27 as the developing roller 31 rotates. At this time, the latent image formed on the surface of the photosensitive drum 27 is transformed into a visible image when the toner is selectively attracted to the electrostatic latent image on the surface of the photosensitive drum 27, thereby developing the latent image.

The transfer roller 30 is disposed below the photosensitive drum 27 and in opposition thereto, and is supported in the drum cartridge 26 so as to be capable of rotating in the direction of the arrow (counterclockwise in FIG. 1). The transfer roller 30 includes a metal roller shaft 30*a* covered by a roller that is formed of an electrically conductive rubber material.

A high-voltage power supply circuit board 52 is disposed below the transfer roller 30. A bias applying circuit 60 (see FIG. 2) mounted on the high-voltage power supply circuit board 52 is connected to the metal roller shaft 30*a*. The bias applying circuit 60 applies a forward transfer bias voltage Va1 to the metal roller shaft 30*a* (hereinafter referred to as a "forward transfer operation") during a transfer operation for transferring a toner image carried on the photosensitive drum 27 to the paper 3 at the transfer position.

In the preferred embodiment, the bias applying circuit 60 applies a reverse transfer bias voltage Va2 having an opposite polarity to the forward transfer bias voltage Va1 to the transfer roller 30 (hereinafter referred to as a "reverse transfer operation") during an operation to clean the transfer roller 30 performed before or after an image-forming operation or between transfer operations during an image-forming operation. When the bias applying circuit 60 applies this reverse transfer bias voltage Va2, toner adherent to the transfer roller 30 is electrically expelled onto the photosensitive drum 27. The developing roller 31 collects the toner expelled onto the photosensitive drum 27 from the transfer roller 30 together with residual toner left on the surface of the photosensitive drum 27 after the transfer operation.

The cleaning brush 64 is disposed in confrontation with the photosensitive drum 27 so as to contact the main drum body of the same. The cleaning brush 64 is configured of an electrically conductive material. A prescribed cleaning bias voltage is applied to the cleaning brush 64. The cleaning brush 64 functions to remove paper dust deposited on the photosensitive drum 27.

(c) Fixing Unit

As shown in FIG. 1, the fixing unit 18 is disposed to the rear side of the process cartridge 17. The fixing unit 18 includes a heating roller 41, a pressure roller 42, and a pair of conveying rollers 43. The heating roller 41 is formed of metal and includes a halogen lamp for generating heat. A motor (not shown) drives the heating roller 41 to rotate in the direction indicated by the arrow (clockwise in FIG. 1). The pressure roller 42 follows the rotation of the heating roller 41, rotating in the direction of the arrow (counterclockwise in FIG. 1), while contacting the heating roller 41 with pressure. The conveying rollers 43 are disposed downstream of the heating roller 41 and pressure roller 42. After toner is transferred onto the paper 3 in the process cartridge 17, the toner is fixed to the paper 3 by heat as the paper 3 passes between the heating roller 41 and pressure roller 42. Subsequently, the conveying rollers 43 convey the paper 3 along a discharge path 44. A pair of discharge rollers 45 disposed on the downstream end of the discharge path 44 discharge the paper 3 onto a discharge tray 46.

The laser printer 1 of the preferred embodiment is further provided with a reverse conveying unit 47 for enabling images to be formed on both surfaces of the paper 3 (duplex printing). The reverse conveying unit 47 includes the discharge rollers 45, a reverse conveying path 48, a flapper 49, and a plurality of reverse conveying rollers 50. Through the cooperation of these members, a sheet of paper 3 having an image formed on one surface can be reversed in direction and reconveyed between the photosensitive drum 27 and the transfer roller 30, thereby enabling images to be formed on both surfaces of the paper 3.

2. Bias Applying Circuit

Figure 2:
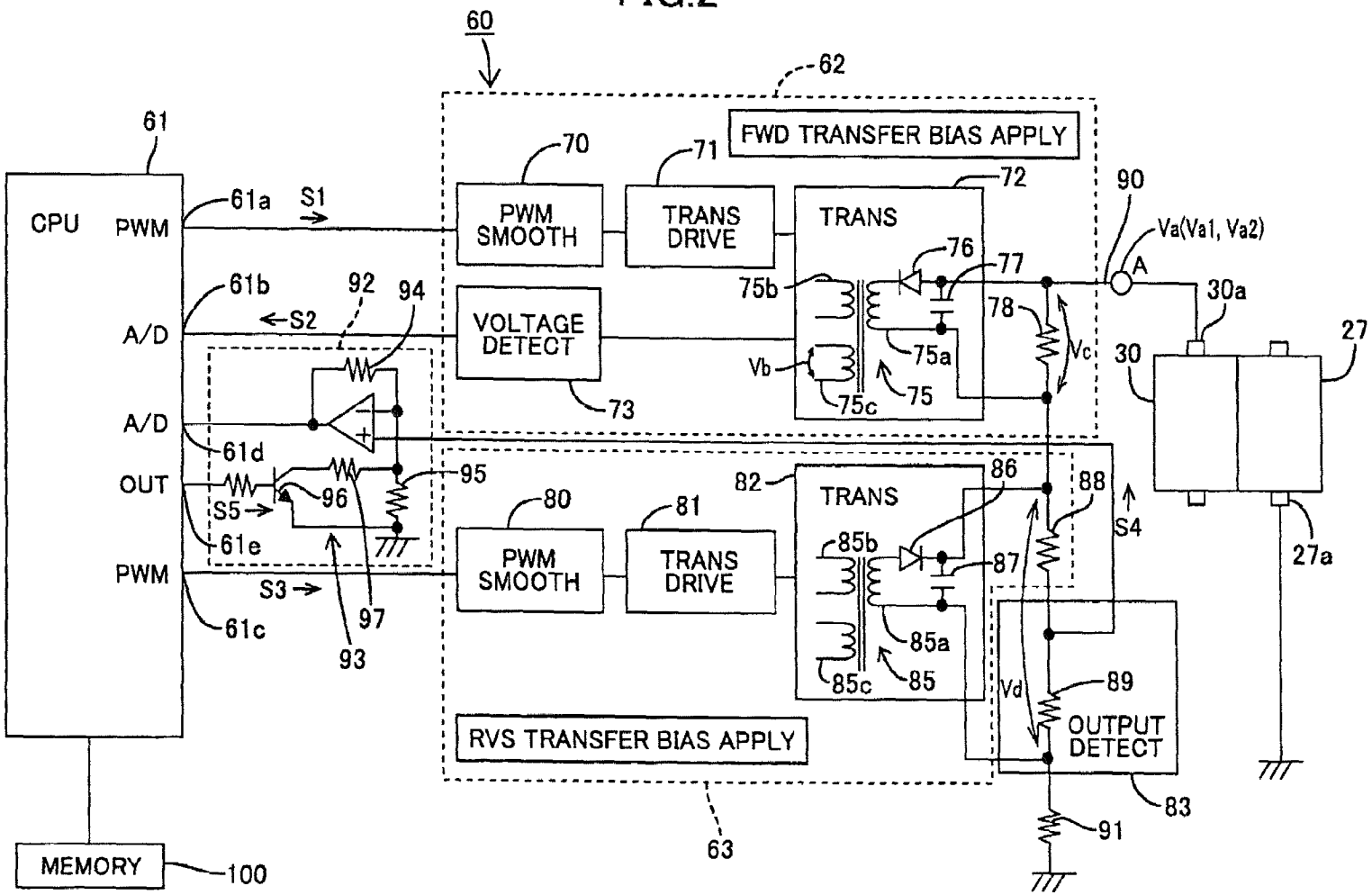
FIG. 2 is a block diagram showing the configuration of a bias applying circuit.

FIG. 2 is a block diagram showing the configuration of the bias applying circuit 60 mounted on the high-voltage power supply circuit board 52. The bias applying circuit 60 applies the forward transfer bias voltage Va1 (negative voltage) to the transfer roller 30 during a forward transfer operation and the reverse transfer bias voltage Va2 (positive voltage) to the transfer roller 30 during a reverse transfer operation.

The bias applying circuit 60 includes a CPU 61, a forward transfer bias applying circuit 62, and a reverse transfer bias applying circuit 63. The forward transfer bias applying circuit 62 and reverse transfer bias applying circuit 63 are connected in series to the metal roller shaft 30*a* of the transfer roller 30 via a connection line 90. The bias applying circuit 60 also includes an output detection circuit 83 for outputting a detection signal S4 corresponding to the current value flowing through the connection line 90. The CPU 61 controls the forward transfer bias applying circuit 62 through current control using pulse width modulation (PWM), and controls the reverse transfer bias applying circuit 63 through constant voltage control using PWM. A memory unit 100 is connected to the CPU 61. The memory unit 100 stores data of a characteristic curve X described later.

(a) Forward Transfer Bias Applying Circuit

The forward transfer bias applying circuit 62 includes a forward transfer PWM smoothing circuit 70, a forward transfer transformer driving circuit 71, a forward transfer boosting and smoothing rectifier circuit 72, and a forward transfer output voltage detecting circuit 73. The forward transfer PWM smoothing circuit 70 receives and smoothes a PWM signal S1 from a PWM port 61*a* of the CPU 61 and applies this smoothed PWM signal S1 to the forward transfer transformer driving circuit 71 for controlling an oscillating current applied to a primary coil 75*b* of the forward transfer boosting and smoothing rectifier circuit 72. The forward transfer transformer driving circuit 71 applies an oscillating current to a primary coil 75*b* of the forward transfer boosting and smoothing rectifier circuit 72 based on the PWM signal S1.

The forward transfer boosting and smoothing rectifier circuit 72 includes a transformer 75, a diode 76, a smoothing capacitor 77. The forward transfer boosting and smoothing rectifier circuit 72 has a secondary coil 75*a*, the primary coil 75*b*, and an auxiliary coil 75*c*. One end of the secondary coil 75*a* is connected to the connection line 90 via the diode 76. The other end of the secondary coil 75*a* is connected to an output terminal of the reverse transfer bias applying circuit 63. Further, the smoothing capacitor 77 and a discharge resistor 78 are connected to the secondary coil 75*a* in parallel.

With this configuration, the forward transfer boosting and smoothing rectifier circuit 72 boosts and rectifies the oscillating current in the primary coil 75*b* and applies the result as the forward transfer bias voltage Va1 to the metal roller shaft 30*a* connected to an output terminal A of the bias applying circuit 60.

The forward transfer output voltage detecting circuit 73 is connected to the CPU 61 and the auxiliary coil 75*c* of the transformer 75 in the forward transfer boosting and smoothing rectifier circuit 72. The forward transfer output voltage detecting circuit 73 detects an output voltage Vb generated in the auxiliary coil 75*c* during a forward transfer operation and inputs a detection signal S2 into an A/D port 61*b* of the CPU 61.

(b) Reverse Transfer Bias Applying Circuit

The reverse transfer bias applying circuit 63 includes a reverse transfer PWM signal smoothing circuit 80, a reverse transfer transformer driving circuit 81, and a reverse transfer boosting and smoothing rectifier circuit 82.

The reverse transfer PWM signal smoothing circuit 80 receives a PWM signal S3 from a PWM port 61*c* of the CPU 61 and applies the PWM signal S3 to the reverse transfer transformer driving circuit 81 for controlling an oscillating current applied to a primary coil 85*b* of the forward transfer boosting and smoothing rectifier circuit. 82. The reverse transfer transformer driving circuit 81 applies an oscillating current to the primary coil 85*b* of the reverse transfer boosting and smoothing rectifier circuit 82 based on the PWM signal S3.

The reverse transfer boosting and smoothing rectifier circuit 82 includes a transformer 85, a diode 86, and a smoothing capacitor 87. The transformer 85 has a secondary coil 85*a*, the primary coil 85*b*, and an auxiliary coil 85*c*. One end of the secondary coil 85*a* is connected to the other end of the secondary coil 75*a* in the forward transfer bias applying circuit 62 via the diode 86. The other end of the secondary coil 85*a* is grounded via a resistor 91. Further, the smoothing capacitor 87 and a pair of resistors 88 and 89 are connected to the secondary coil 85*a* in parallel. In the preferred embodiment, the resistor 89 functions as a detection resistor. A detection signal S4 corresponding to the current value of electric current flowing through the resistor 89 is fed back to an A/D port 61*d* of the CPU 61 via an amplifying circuit 92.

With this configuration, the reverse transfer boosting and smoothing rectifier circuit 82 boosts and rectifies the oscillating current in the primary coil 85*b* and applies the result as the reverse transfer bias voltage Va2 to the metal roller shaft 30*a* connected to the output terminal A of the bias applying circuit 60.

During a forward transfer operation, the CPU 61 executes current control by applying the PWM signal S1 to the forward transfer bias applying circuit 62 in order to drive the same. At this time, the CPU 61 outputs to the forward transfer PWM smoothing circuit 70 the PWM signal S1 having a duty ratio suitably modified based on the detection signal S4, where the detection signal S4 corresponds to the value of electric current flowing through the connection line 90, so that the current flowing in the connection line 90 is maintained at an optimal output current It described later.

During a reverse transfer operation, the CPU 61 performs constant voltage control by applying the PWM signal S3 to the reverse transfer bias applying circuit 63 in order to drive the same. At this time, the PWM signal S3 outputted to the reverse transfer PWM signal smoothing circuit 80 has a duty ratio suitably modified based on the detection signal S4, where the detection signal S4 corresponds to the negative voltage of the resistor 89, so that the negative voltage of the resistor 89 is maintained at a prescribed constant voltage.

In the preferred embodiment, the detection signal S4 from the output detection circuit 83 is fed back to the common A/D port 61*d* in both the forward transfer operation and the reverse transfer operation. However, the forward transfer bias voltage Va1 required for the forward transfer operation and the reverse transfer bias voltage Va2 required for the reverse transfer operation have different voltage levels. Hence, the amplifying circuit 92 is provided with a gain modifying circuit 93 for adjusting the gain of the detection signal S4.

Specifically, the gain modifying circuit 93 includes a transistor 96 (a thin film transistor or the like) as a switch. The collector of the transistor 96 is connected between a pair of feedback resistors 94 and 95 via a switch resistor 97. The feedback resistors 94 and 95 determine the gain of the amplifying circuit 92. The base of the transistor 96 is connected to an output port 61*e* of the CPU 61, while the emitter is grounded. The CPU 61 outputs a command signal S5 from the output port 61*e* to turn the transistor 96 on. The resistance values of the switch resistor 97 and feedback resistor 95 are regulated so that the levels of detection signals S4 introduced into the A/D port 61*d* during the forward transfer operation and the reverse transfer operation are within the same range.

The CPU 61 does not output the command signal S5 from the output port 61*e* when outputting the PWM signal S1, for example, during a forward transfer operation. In this case, the detection signal S4 is amplified by a gain determined by the resistance values in the feedback resistors 94 and 95 and is subsequently inputted into the A/D port 61*d*. Based on the inputted detection signal S4, the CPU 61 performs feedback control of the forward transfer bias applying circuit 62 for a forward transfer operation.

However, during a reverse transfer operation for outputting the PWM signal S3, for example, the CPU 61 outputs the command signal S5 from the output port 61*e*. In this case, the detection signal S4 is amplified by a gain determined by resistance values in the feedback resistor 94 and the combined resistance of the feedback resistors 95 and the switch resistor 97, and subsequently inputs the detection signal S4 into the A/D port 61*d*. Based on the inputted detection signal S4, the CPU 61 performs feedback control with the reverse transfer bias applying circuit 63 for a reverse transfer operation.

3. Basic Control Method for a Forward Transfer Operation

Resistance values of the transfer roller 30, the photosensitive drum 27, and the paper 3 interposed between the transfer roller 30 and photosensitive drum 27 can vary due to ambient conditions such as temperature and humidity. Accordingly, transfer problems may arise during a forward transfer operation, particularly if the supply of power is not adjusted to adapt to these changes in ambient conditions. Transfer problems include essentially any condition that adversely affects printing quality, such as scattered toner caused by insufficient transfer power and electrical discharge caused by excessive transfer power.

Therefore, in the preferred embodiment, the duty ratio of the PWM signal S1 is increased or decreased to achieve an optimal current flowing through the transfer roller 30, photosensitive drum 27, and paper 3. Specifically, the duty ratio is adjusted so that an output current Ii indicated by the detection signal S4 received from the output detection circuit 83 is an optimal value derived from the characteristic curve X described next.

(1) Characteristic Curve

The characteristic curve X of the preferred embodiment 15 is a curve that approximates an optimal output current It according to the exponential function $y=Ax^B$, where a coefficient B<0. The optimal output current It corresponding to a load resistance Ri of the transfer roller 30, photosensitive drum 27, and interposed paper 3 is found experimentally.

Figure 3:
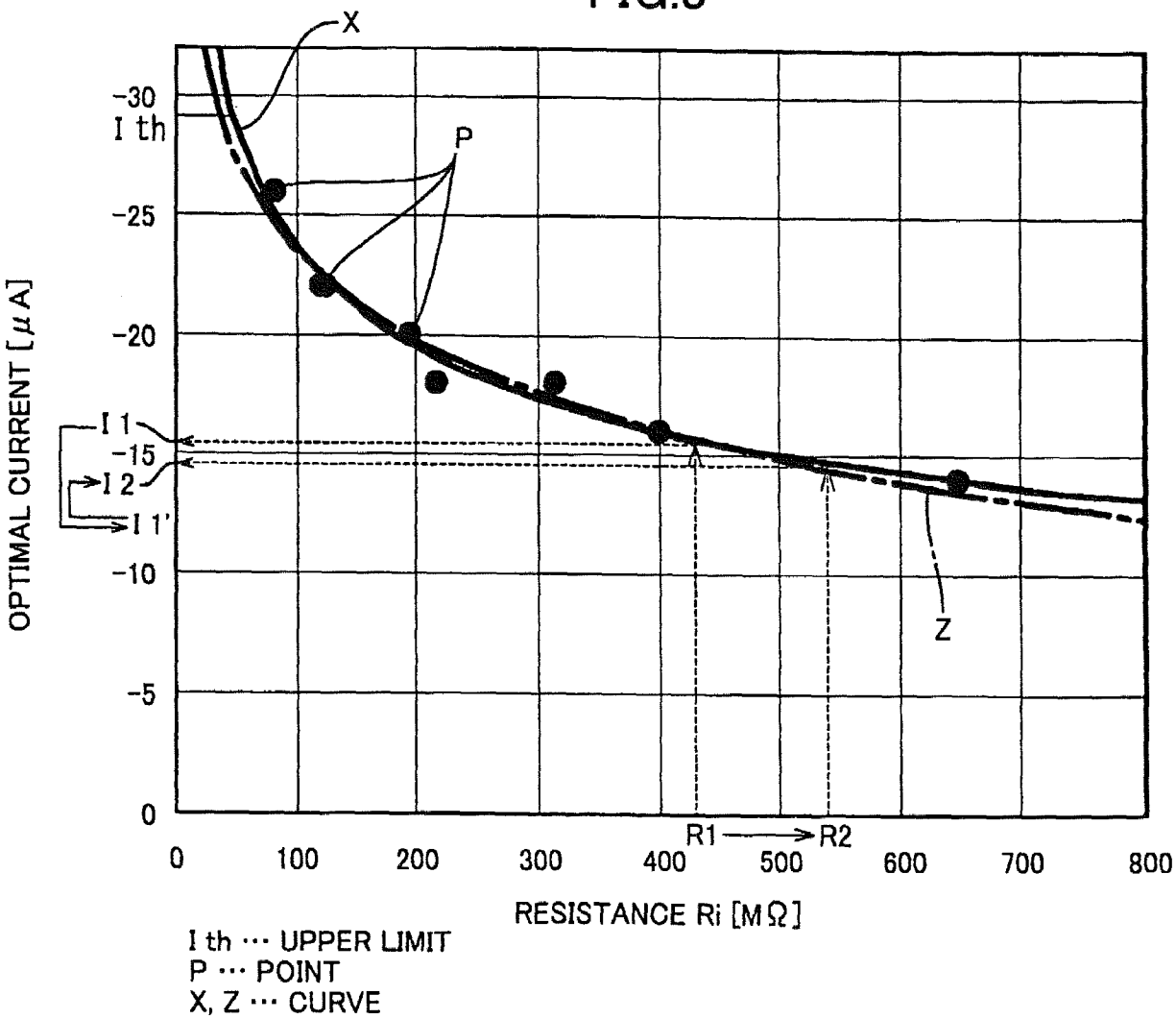
FIG. 3 is a graph showing experimental results and characteristic curves.

The graph in FIG. 3 shows plotted points P of the optimal output current It corresponding to the load resistance Ri, and the characteristic curve X derived by approximating these points P. The load resistance Ri is the resistance value obtained when changing the ambient temperature under minimum humidity (20% in the preferred embodiment), where minimum humidity is stipulated in the recommended conditions for use by the manufacturer of the laser printer 1. The optimal output current It is found experimentally for all values of load resistance Ri at which essentially no transfer problems occur when the laser printer 1 is performing a printing operation.

Figure 4:
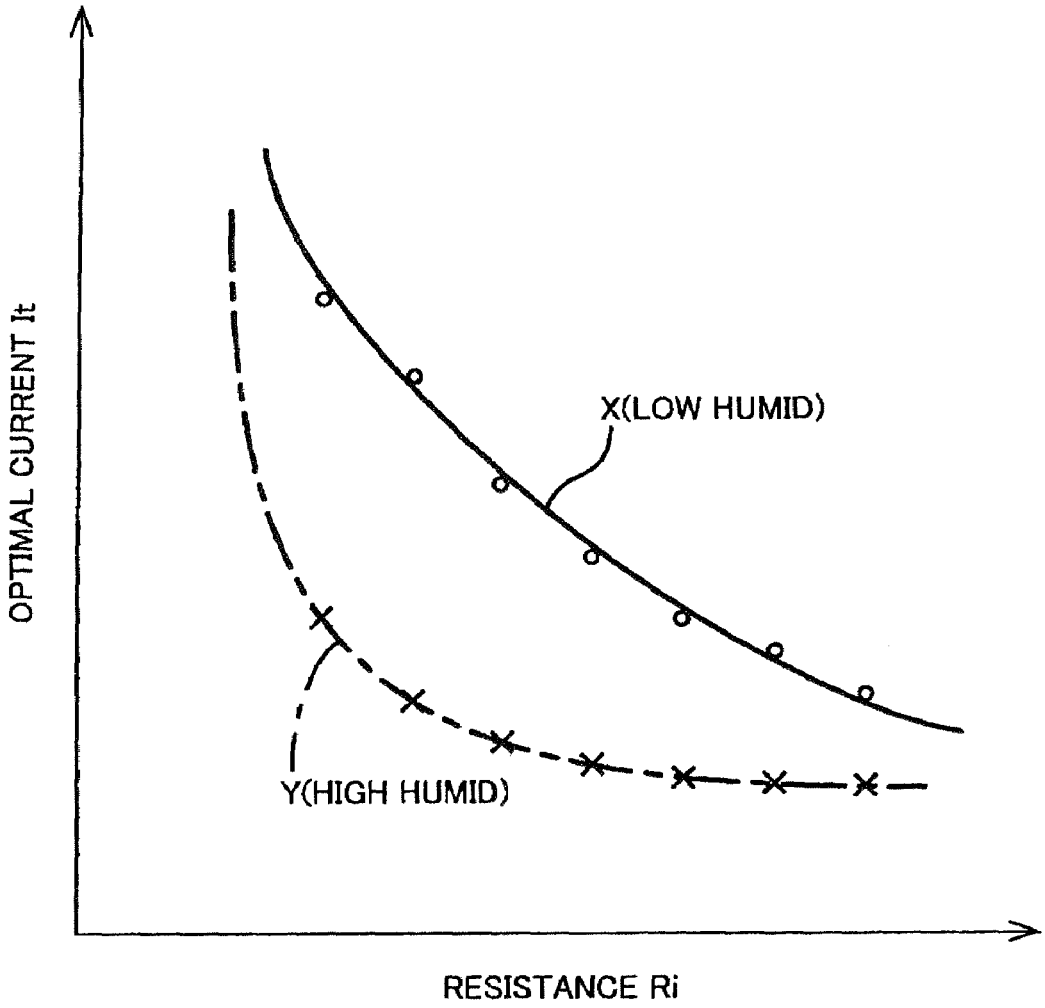
FIG. 4 is an explanatory diagram showing a correlation between load resistance and optimal output current.

Next, the reason for plotting experimental results under minimum humidity in the preferred embodiment will be described. Normally, the load resistance Ri during a transfer operation fluctuates more due to humidity than to temperature. FIG. 4 shows a general depiction of the optimal output current It corresponding to the load resistance Ri when varying temperature under two different humidity conditions. The characteristic curve X in FIG. 4 was obtained by approximating experimental results when modifying the temperature under the minimum humidity described above, while the curved line Y was obtained by approximating experimental results when modifying temperature under maximum humidity, where maximum humidity is also stipulated in the manufacturer's recommended conditions for usage.

As can be seen from this graph, the optimal output current It in the characteristic curve X is larger than that in the curved line Y. If the curved line Y that was derived from experimental results under maximum humidity is employed under lower humidity, a transfer current can be insufficient, resulting in such transfer problems as scattered toner-on the paper 3 and ghost images. Ghost images occur when toner is not sufficiently transferred onto the paper-3 and remains on the photosensitive drum 27. After the photosensitive drum 27 rotates one revolution, the residual toner-on the photosensitive drum 27 is transferred at a different position on the sheet of paper 3 contacting the photosensitive drum 27.

However, when employing the characteristic curve X derived from experimental results under the minimum humidity, it has been confirmed experimentally that discharge caused by excessive transfer power, even under high humidity, causes essentially no adverse effects to printing quality. Accordingly, the preferred embodiment employs the characteristic curve X based on experimental results under minimum humidity.

The characteristic curve X in the preferred embodiment is found by approximating the plotted points P of experimental results under minimum humidity using the exponential function $y=Ax^B$, where B<0, and can be expressed with the following equation 1.

optimal output current $It=A\cdot Ri^{B}$ (Equation 1)

Ri: detected load resistance

A, B: coefficients, where A<0 and B<0 (however, A>0 when the forward transfer bias voltage Va1 is positive)

Instead of the exponential function, it is also possible to use a logarithmic function for approximating the plotted points P (indicated by the broken line Z in FIG. 3). As can be seen in FIG. 3, both characteristic curves Z and X closely approximate the path of the plotted points P. The characteristic curve Z can be expressed by the following equation 2.

optimal output current $It=C\cdot\ln(Ri)+D$ (Equation 2)

Ri: detected load resistance

C, D: coefficients, where C<0 and D<0 (however, C>0 and D≧0 when the forward transfer bias voltage Va1 is positive)

(2) Control Process during a Forward Transfer Operation

At a prescribed control timing, the CPU 61 retrieves the detection signals S2 and S4 and calculates the current load resistance Ri based on the detection signals S2 and S4. The CPU 61 derives the optimal output current It corresponding to this load resistance Ri using the characteristic curve X and sets a control target value to this optimal output current It. At the next control timing, the CPU 61 outputs the PWM signal S1 having a duty ratio adjusted according to the amount of difference between the optimal output current It and the current output current Ii.

In other words, the CPU 61 calculates the load resistance Ri based on the detection signals S2 and S4. The CPU 61 detects the output current Ii flowing to the transfer roller 30 and the like from the detection signal S4 and detects the output voltage Vb generated in the auxiliary coil 75*c* from the detection signal S2. The applied voltage Vi applied to the transfer roller 30 is found by adding a voltage Vc produced by multiplying a voltage ratio n between the auxiliary coil 75*c* and secondary coil 75*a* by the output voltage Vb to a voltage Vd produced by multiplying the output current Ii by the resistors 88 and 89. The load resistance Ri under the current ambient conditions is set to the result of dividing the applied voltage Vi by the output current Ii.

load resistance $Ri=\{n*Vb+(r1+r2)*Ii\}/Ii$ (Equation 3)

r1, r2: resistance values for resistors 88 and 89

Next, the CPU 61 derives the optimal output current It corresponding to the current load resistance Ri calculated above using the characteristic curve X. In the preferred embodiment, data for the characteristic curve X is stored in the memory unit 100 as functional data for equation 1. The CPU 61 reads data for the characteristic curve X from the memory unit 100 and calculates the optimal output current It.

Figure 5A:
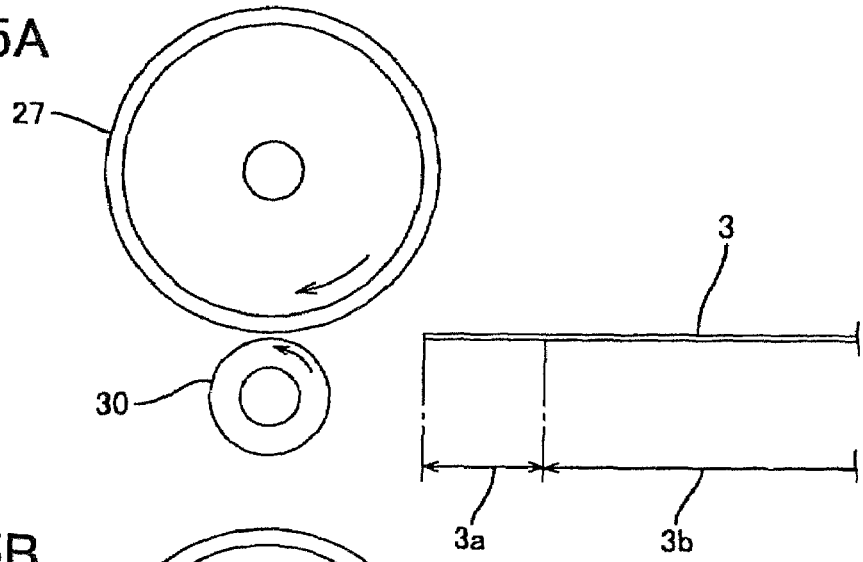
FIG. 5A is an explanatory diagram illustrating positions of a paper before the paper reaches a transfer position between a photosensitive drum and transfer roller.
Figure 5B:
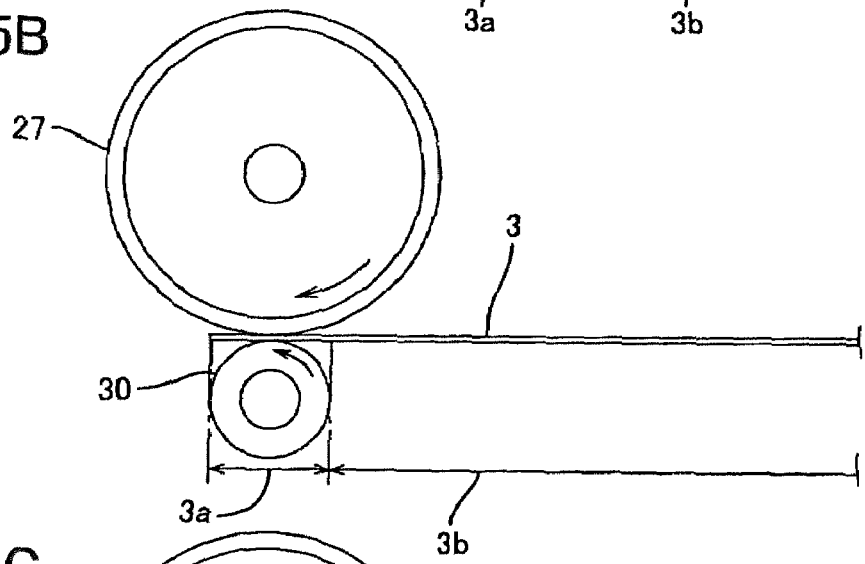
FIG. 5B is an explanatory diagram illustrating positions of a paper when a leading edge of the paper reaches a transfer position.
Figure 5C:
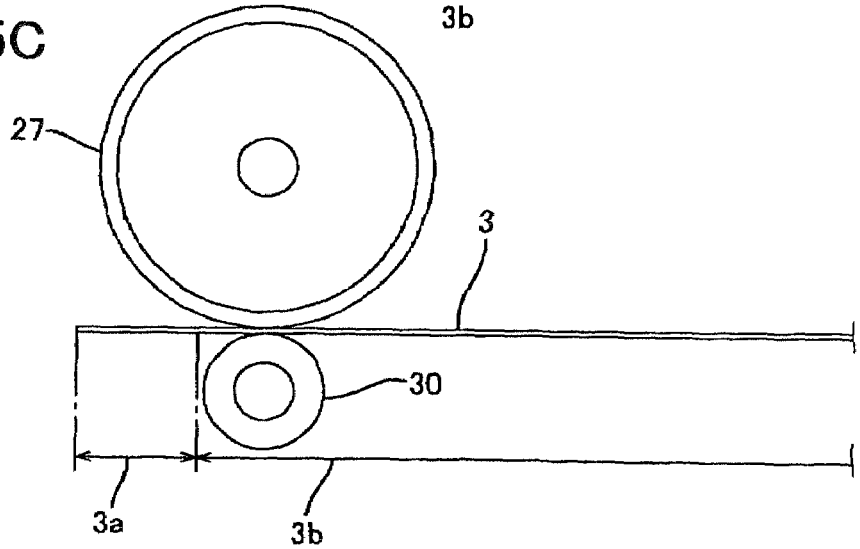
FIG. 5C is an explanatory diagram illustrating positions of a paper when before a printable region of the paper reaches a transfer position between a photosensitive drum and transfer roller.

As shown in FIGS. 5A-5C, the load resistance is "R1" before the paper 3 reaches the transfer position between the photosensitive drum 27 and transfer roller 30 (FIG. 5A). At this time, the output current value is "I1". At the next control timing, the load resistance on the transfer roller 30 changes to "R2" when a leading edge 3*a* of the paper 3 reaches the transfer position (FIG. 5B), and the current to output electric current value drops temporarily to "I1" At this time, the CPU 61 calculates the optimal output current "I2" corresponding to the current load resistance "R2" based on the characteristic curve X.

The CPU 61 sets a duty ratio Dt for the PWM signal S1 to be outputted at the next control timing based on the following equation 4.

next duty ratio $Dt=Di+(I2-I1')*K$ (Equation 4)

Di: current duty ratio

I2−I1': difference between the optimal output current and the current output current K: coefficient Accordingly, before a center portion 3*b* of the paper 3 is positioned at the transfer position, an optimal output current "I2" corresponding to the load resistance "R2" after changes in resistance caused by the existence of the paper 3 is applied to the transfer roller 30 and the like. In this way, transfer problems caused by variations in load resistance can be avoided.

(3) Control Timing

In an image-forming device such as the laser printer 1, the printable region (image-forming region) of the paper 3 is set to the center portion and excludes the edges on the four sides of the paper 3. The image-forming region is a region on the recording medium for which a uniform image forming quality is ensured, and normally excludes the peripheral edges of the recording medium. In FIGS. 5A-5C, the leading edge 3*a* of the paper 3 is an unprintable region, while the center portion 3*b* is the printable region. In the preferred embodiment, the CPU 61 performs the control process after the leading edge 3*a* of the paper 3 arrives at the transfer position and until the printable region of the paper 3 arrives at the transfer position.

In other words, the CPU 61 executes the control 20 process at least one time after the leading edge 3*a* of the paper 3 is interposed in the transfer position and the load resistance Ri has first changed and while the leading edge 3*a* of the paper 3 is passing through the transfer position. Therefore, images can be transferred onto the center portion 3*b* of the paper 3 using the optimal output current It corresponding to the changed load resistance Ri. This control timing is determined according to the conveying speed of the paper 3 and the length of the unprintable region in the conveying direction.

(4) Upper Limit of the Optimal Output Current Value

As shown in FIG. 3, the characteristic curves X and Z indicate a rapid increase in the optimal output current. It as the load resistance Ri approaches 0. Therefore, when the load resistance Ri becomes relatively small, there is a danger that the corresponding optimal output current It will become excessive and cause damage to internal circuitry and the like. Accordingly, the preferred embodiment has an upper limit Ith for the optimal output current It. When the optimal output current It calculated according to the characteristic curves X and Z is greater than or equal to the upper limit Ith, then the optimal output current It is set to the upper limit Ith.

4. Effects of the Preferred Embodiment (1) In the preferred embodiment, the characteristic curve X is derived through an approximation using the exponential function $y=Ax^{B}$, or the characteristic curve Z is derived using a logarithmic approximation. These methods can achieve precise power control while preventing a drop in response. The characteristic curve may be derived from plotted points P for experimental results, as shown in FIG. 3, using a linear approximation, a trigonometric function approximation, or the like.

(2) Further, when the moisture state of a single sheet of paper 3 is irregular, the load resistance Ri at different areas of the paper 3 is also different. Therefore, in the preferred embodiment, the output current Ii is controlled at a timing interval shorter than the transfer operation time for the entire sheet of paper 3 (specifically, the time from when the leading edge of the paper 3 arrives at the transfer position until the trailing edge of the paper 3 passes the transfer position). Accordingly, optimal transfer can be performed on all portions of the paper 3.

(3) Further, in the preferred embodiment, the timing interval for control performed by the CPU 61 is set shorter than the time beginning when the leading edge of the paper 3 arrives at the transfer position and ending when the printable region of the paper 3 arrives at the transfer position. Hence, the transfer operation can be performed on the printable region of the paper 3 at the optimal output current It. This power control may be performed just on the leading edge of the paper 3 or can be continued throughout the entire length of the paper 3 in the conveying direction.

(4) Further, the characteristic curve X (or characteristic curve Z) approximates the plotted points P for experimental results under minimum humidity. When employing the characteristic curve X derived from experimental results under minimum humidity, it has been confirmed through experiment that electrical discharge caused by excessive transfer power has essentially no effect on printing quality, even under high humidity conditions. Therefore, the present invention can prevent transfer problems caused by changes in ambient conditions (particularly temperature and humidity).

(5) The preferred embodiment is also provided with an upper limit Ith for the optimal output current It. When the optimal output current It calculated based on the characteristic curves X and Z is greater than or equal to the upper limit Ith, then the optimal output current It is set to the upper limit Ith. This method can prevent excessive current.

Second Embodiment

Next, an image-forming device according to a second embodiment of the present invention will be described. The second embodiment differs from the first embodiment in the method of calculating the characteristic curve, while all other points of the second embodiment are identical to those in the first embodiment. Accordingly, like parts and components have been designated with the same reference numerals to avoid duplicating description, and only differing parts will be described below.

1. Characteristic Curve

Figure 6:
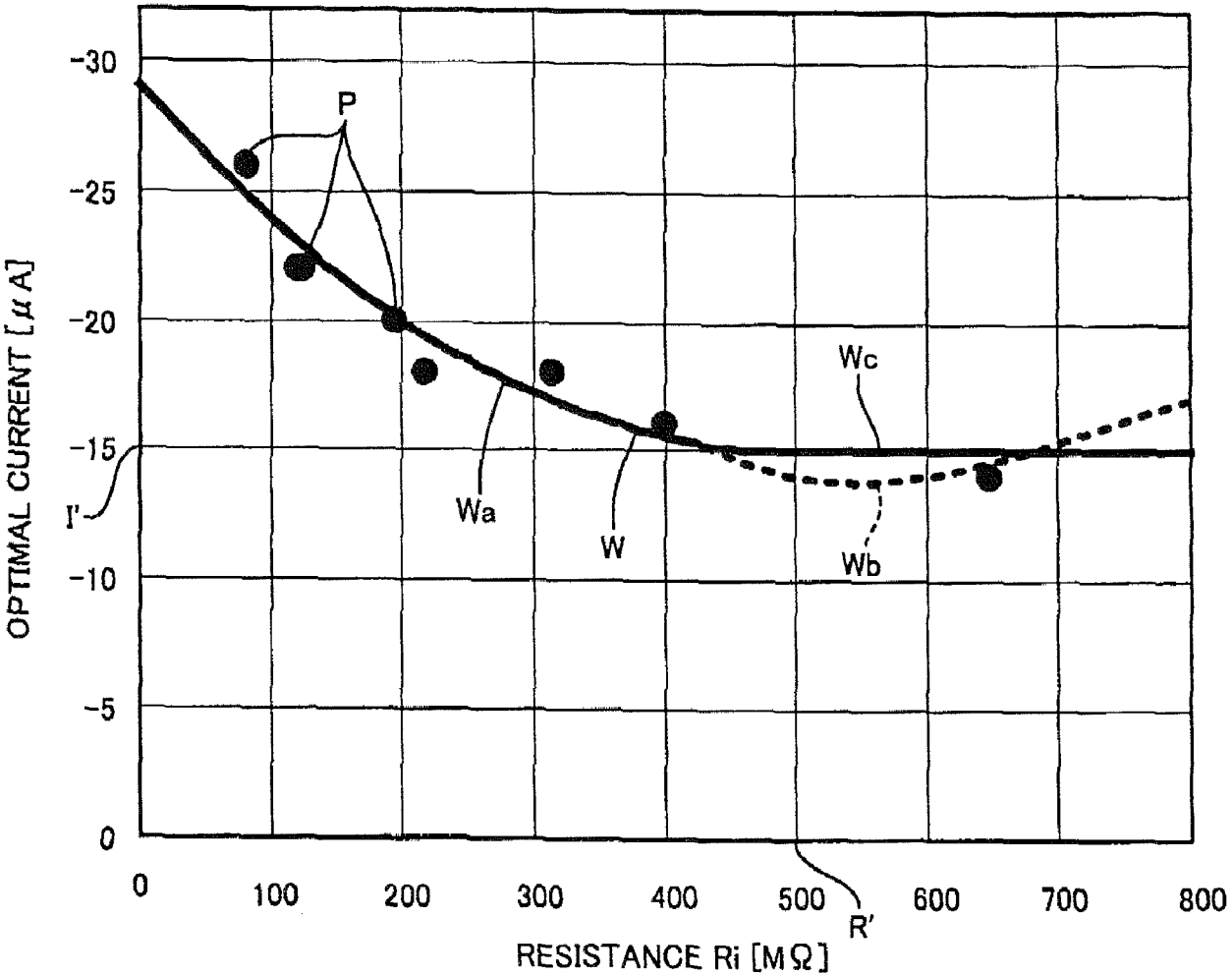
FIG. 6 is a graph showing the experimental results and a characteristic curve according to a second embodiment of the present invention.

FIG. 6 is a graph showing plotted points P for experiment results under minimum humidity, and a characteristic curve W. The characteristic curve W is derived by approximating the plotted points P primarily with a second-order function. More specifically, the experimental results approach a second-order curve Wa when the load resistance Ri is less than about 500 MΩ and a straight line Wc when the load resistance Ri is more than about 500 MΩ. The second-order function has an inflection point at which second-order function reverses its increasing/decreasing trend around 500 MΩ. On the other hand, the absolute value |It| of the optimal output current decreases as the load resistance Ri increases in the experimental results under minimum humidity. Accordingly, the second-order curve Wa is used on the left side of the inflection point while a second-order curve Wb (indicated by a dotted line) is not used on the right of the inflection point. The straight line Wc is used on the right side of the inflection point instead of the second-order curve Wb. It is also possible to use another straight line or curved line having the same increasing/decreasing trend for the left edge of the second-order curve Wa or use a combination of these lines.

As a result, the characteristic curve W can be expressed by the following equation 5.

optimal output current $It=E(Ri-F)^2+G$ (when $Ri<R'$)

optimal output current $It=I'$(when $Ri \geqq R'$) (Equation 5)

where $R' \leqq F$ and $I' \leqq G$

Ri: detected load resistance

E, F, G: coefficients, where $E<0$, $F>0$, $G \leqq 0$ (however, $E>0$, $G \geqq 0$, and $I' \geqq G$ when the forward transfer bias voltage Va1 is positive)

2. Effects of the Second Embodiment

In the second embodiment, the characteristic curve W is approximated according to an integral (polynomial) function that does not include any calculation other than addition, subtraction, and multiplication (including exponents). Hence, it is possible to perform high precision power control without rounding errors which are generated by the subtraction. Further, since the integral equation is a second-order function, it is also possible to perform power control with high response

Variations of the Embodiments

While the invention has been described in detail with reference to specific embodiments thereof, it would be apparent to those skilled in the art that many modifications and variations may be made therein without departing from the spirit of the invention, the scope of which is defined by the attached claims.

(1) In the preferred embodiments described above, characteristic curves X, Z, and W are used to indicate a correlation between the load resistance Ri and the corresponding optimal output current It. However, a characteristic curve showing a correlation between the applied voltage Vi and the corresponding optimal output current It may be used.

(2) It is also possible to control the voltage value. In this case, characteristic curves X', Z', and W' indicating a correlation between the load resistance Ri and the corresponding optimal output voltage value Vt can be used in place of the optimal output current It. Further, a characteristic curve indicating a correlation between the output current Ii and the corresponding optimal output voltage value Vt may also be used.

(3) In the preferred embodiments described above, data for the characteristic curves X, Z, and W is stored in the memory unit 100 as functional data of equations 1, 2, and 5, and the CPU 61 reads this data from the memory unit 100 to calculate the optimal output current It. However, a table showing a correspondence between the load resistance Ri and the optimal output current It on the characteristic curves X, Z, and W may be stored in the memory unit 100 instead. This configuration can reduce the computation load on the CPU 61.

(4) Further, a characteristic curve may be provided for each type of recording medium (according to material, thickness, and the like), and the above control may be performed by selecting a characteristic curve corresponding to the specific type of recording medium being used for printing.

(5) Though the second-order function is used at a part of the characteristic curve in the second embodiment, an N-order function may be used. Since there is a plurality of inflection points in the N-order function, an integral function can be changed at each inflection point.

What is claimed is:

1. An image-forming device comprising:

an image-carrying unit that supports a toner;

a transferring unit that transfers the toner supported on the image-carrying unit onto a recording medium, the transferring unit opposing to the image-carrying unit at a transferring position;

a power-supplying unit that supplies voltage and current to the transferring unit to transfer the toner onto the recording medium;

a current-detecting unit that detects the current flowing in the transferring unit; a voltage-detecting unit that detects the voltage applied to the transferring unit;

a memory unit that stores a characteristic curve indicating a correlation between an optimal current and at least the detected voltage, the optimal current enabling the transferring unit to transfer the toner supported on the image-carrying unit onto the recording medium; and a controller that controls the power-supplying unit to supply the optimal current to the transferring unit.

2. The image-forming device according to claim 1, the characteristic curve is acquired by an experiment.

3. The image-forming device according to claim 1, the characteristic curve is approximated by a function.

4. The image-forming device according to claim 3, wherein the characteristic curve is approximated by an exponential function $y=Ax^B$.

5. The image-forming device according to claim 4, wherein the coefficient B of the exponential function is a negative number.

6. The image-forming device according to claim 3, wherein the characteristic curve is approximated by a logarithmic function.

7. The image-forming device according to claim 3, wherein the characteristic curve is approximated by an integral function.

8. The image-forming device according to claim 7, wherein the integral function is an N-order integral function, N being a natural number of 2 or greater.

9. The image-forming device according to claim 7, wherein the characteristic curve is a combination of parts of the integral functions, wherein the part of the integral function has either a continuously increasing trend or a continuously decreasing trend, and the continuously increasing/decreasing trend of one part depends on the continuously increasing/decreasing trend of another part.

10. The image-forming device according to claim 7, wherein the characteristic curve is a combination of a part of the integral function and a straight line, wherein the part of the integral function and the straight line have either a continuously increasing trend or a continuously decreasing trend respectively, and the continuously increasing/decreasing trend of the straight line depends on the continuously increasing/decreasing trend of the part of the integral function respectively.

11. The image-forming device according to claim 1, wherein the characteristic curve indicates a correlation between the optimal current and a resistance acquired based on the detected current and the detected voltage.

12. The image-forming device according to claim 1, wherein the controller supplies the optimal current to the transferring unit within a prescribed time interval shorter than a length of time needed to transfer the toner onto the recording medium.

13. The image-forming device according to claim 12, wherein the recording medium has a leading edge and an image-forming region, the prescribed time interval is shorter than a length of time between a time when the leading edge reaches the transferring position and a time when the image-forming region reaches the transferring position.

14. The image-forming device according to claim 1, wherein the optimal current is measured under a minimum humidity condition among a humidity condition where is recommended for a normal performance of the image-forming device.

15. The image-forming device according to claim 1, wherein the optimal current has an upper limit.

16. The image-forming device according to claim 1, wherein the memory unit stores a plurality of characteristic curves each corresponding to a type of the recording medium, the controller selecting a relevant characteristic curve based on the type of the recording medium.

17. An image-forming device comprising:

an image-carrying unit that supports a toner;

a transferring unit that transfers the toner supported on the image-carrying unit onto a recording medium, the transferring unit opposing to the image-carrying unit at a transferring position;

a power-supplying unit that supplies voltage and current to the transferring unit to transfer the toner onto the recording medium;

a current-detecting unit that detects the current flowing in the transferring unit;

a voltage-detecting unit that detects the voltage applied to the transferring unit;

a memory unit that stores a characteristic curve indicating a correlation between an optimal voltage and at least the detected current, the optimal voltage enabling the transferring unit to transfer the toner supported on the image-carrying unit onto the recording medium; and a controller that controls the power supplying unit to supply the optimal voltage to the transferring unit.

18. The image-forming device according to claim 17, the characteristic curve is acquired by an experiment.

19. The image-forming device according to claim 17, the characteristic curve is approximated by a function.

20. The image-forming device according to claim 19, wherein the characteristic curve is approximated by an exponential function $y=Ax^B$.

21. The image-forming device according to claim 20, wherein the coefficient B of the exponential function is a negative number.

22. The image-forming device according to claim 19, wherein the characteristic curve is approximated by a logarithmic function.

23. The image-forming device according to claim 19, wherein the characteristic curve is approximated by an integral function.

24. The image-forming device according to claim 23, wherein the integral function is an N-order integral function, N being a natural number of 2 or greater.

25. The image-forming device according to claim 23, wherein the characteristic curve is a combination of parts of the integral functions, wherein the part of the integral function has either a continuously increasing trend or a continuously decreasing trend, and the continuously increasing/decreasing trend of one part depends on the continuously increasing/decreasing trend of another part.

26. The image-forming device according to claim 23, wherein the characteristic curve is a combination of a part of the integral function and a straight line, wherein the part of the integral function and the straight line have either a continuously increasing trend or a continuously decreasing trend respectively, and the continuously increasing/decreasing trend of the straight line depends on the continuously increasing/decreasing trend of the part of the integral function respectively.

27. The image-forming device according to claim 19, wherein the characteristic curve indicates a correlation between the optimal voltage and a resistance acquired based on the detected current and the detected voltage.

28. The image-forming device according to claim 17, wherein the controller supplies the optimal voltage to the transferring unit within a prescribed time interval shorter than a length of time needed to transfer the toner onto the recording medium.

29. The image-forming device according to claim 28, wherein the recording medium has a leading edge and an image-forming region, the prescribed time interval is shorter than a length of time between a time when the leading edge reaches the transferring position and a time when the image-forming region reaches the transferring position.

30. The image-forming device according to claim 17, wherein the optimal voltage is measured under a minimum humidity condition among a humidity condition where is recommended for a normal performance of the image-forming device.

31. The image-forming device according to claim 17, wherein the optimal voltage has an upper limit.

32. The image-forming device according to claim 17, wherein the memory nit stores a plurality of characteristic curves each corresponding to a type of the recording medium, the controller selecting a relevant characteristic curve based on the type of the recording medium.

* * * * *

UNITED STATES PATENT AND TRADEMARK OFFICE

CERTIFICATE OF CORRECTION

PATENT NO. : 7,376,366 B2
APPLICATION NO. : 11/199260
DATED : May 20, 2008
INVENTOR(S) : Hideaki Deguchi It is certified that error appears in the above-identified patent and that said Letters Patent is hereby corrected as shown below:

In Column 18, Claim 32, Line 10:
Please remove “nit” and insert --unit--.

Signed and Sealed this

Twenty-sixth Day of May, 2009

JOHN DOLL
*Acting Director of the United States Patent and Trademark Office*